US005487496A

United States Patent [19]

Benson

[11] Patent Number: 5,487,496

[45] Date of Patent: Jan. 30, 1996

[54] LEAD DELIVERY SYSTEM FOR CASTING STRAPS IN THE MANUFACTURE AND ASSEMBLY OF LEAD-ACID BATTERIES

[75] Inventor: Cory D. Benson, Savage, Minn.

[73] Assignee: GNB Battery Technologies, Inc., Mendota Heights, Minn.

[21] Appl. No.: 295,291

[22] Filed: Aug. 24, 1994

[51] Int. Cl.[6] ..... B22D 35/06

[52] U.S. Cl. ..... 222/593; 266/206

[58] Field of Search ..... 222/590, 591, 222/595, 593; 266/200, 206, 236; 164/98, 309, 337, 306

[56] References Cited

U.S. PATENT DOCUMENTS

| | | | |
|---|---|---|---|
| 1,082,314 | 12/1913 | Garrys | 222/595 |
| 2,735,148 | 2/1956 | Shannon et al. | 164/493 |
| 3,057,025 | 10/1962 | Sutton | 266/206 |
| 3,929,263 | 12/1975 | Heimdal et al. | 222/595 |
| 4,284,122 | 8/1981 | Oxenreider et al. | 164/98 |
| 5,146,974 | 9/1992 | Mayer et al. | 222/595 |

*Primary Examiner*—Scott Kastler
*Attorney, Agent, or Firm*—Leydig, Voit & Mayer, Ltd.

[57] ABSTRACT

An apparatus for delivering molten lead or a lead alloy to the cast-on-strap molds used in the manufacture and assembly of lead-acid batteries is disclosed which comprises a lead delivery member having a lead reservoir of the molten lead or lead alloy, at least one nozzle communicating with the lead reservoir and having an outlet, a valve for each nozzle which controls the amount of lead delivered to the molds when the apparatus is in a lead delivery position, and a heater for maintaining the molten lead at a selected temperature, a frame structure for mounting the apparatus to allow the lead supply member to be rotated between the lead delivery position and a home or wait position about an axis of rotation, a stepper motor and a right angle gear reducer to rotate the lead supply member between the respective positions, the lead reservoir being positioned sufficiently close to the axis of rotation so as to allow movement of the lead delivery member at a selected rate between the lead delivery and wait positions, and the outlet of the nozzle being positioned directly above the cast-on-strap mold when the lead supply member is in the lead delivery position.

10 Claims, 5 Drawing Sheets

LEAD DELIVERY SYSTEM FOR CASTING STRAPS IN THE MANUFACTURE AND ASSEMBLY OF LEAD-ACID BATTERIES

FIELD OF THE INVENTION

This invention relates to lead-acid batteries and, more particularly, to an apparatus for delivering molten lead or a lead alloy to the cast-on-strap molds used in the manufacture and assembly of lead-acid batteries.

DESCRIPTION OF THE PRIOR ART

The cell elements used in lead-acid batteries, such as SLI batteries (i.e., batteries used for the starting, lighting and ignition of automobiles and other vehicles) comprise a series of alternating positive and negative plates with separators positioned therebetween. The electrical connections for the positive plates, and the negative plates as well, are typically made by a strap which connects the lugs of individual plates together. The straps are made of a wide variety of molten lead, or, more usually, lead-based alloys.

Various machines have been developed and used over the years to cast the straps onto the cell elements in a semi-continuous manner. Such machines have often been termed "cast-on-strap machines." Generally, cast-on-strap machines require inserting the cell element upside down into a mold for the strap. The lug elements for the respective plates are thus positioned in a mold containing the requisite molten lead or molten lead alloy, and the molten material is allowed to solidify. The cell element is then removed with the cast-on-strap in place.

Efforts over the years have been made to automate this and other battery assembly operations. In some automated battery assembly lines, a turntable having various stations is provided. At one or more positions on the turntable, the molds for the straps are presented. It is likewise possible that; the assembly of the batteries would use means other than a turntable to provide a multiple position assembly operation. At any rate, what is often involved are circumstances in which the delivery system for the molten lead to the strap for the molds must be periodically moved into and out of the position where the molten lead is delivered to the respective molds. For example, it is necessary in many assembly lines to be able to move the lead delivery system away from the cast-on-strap molds to allow the apparatus for inserting the cell elements into the molds to accomplish its necessary functions.

The many requirements for such lead delivery systems present considerable impediments to the design of suitable lead delivery systems. It is thus desirable to provide compatibility with desired rates of commercial production which requires that the molds be filled in an exceedingly short period of time and then moved sufficiently so that the cell element mechanism can lower or otherwise position the cell elements in the respective molds, e.g., commercial production rates would make it desirable to be able to accomplish such sequencing from one position to the other in times of one-half second or even less. Yet, safety considerations must be maintained. The molten lead or lead alloys used for casting straps is typically maintained in a temperature range of, for example, 750° F.–950° F. or so. Accordingly, the lead delivery system must minimize, and desirably essentially eliminate, any spilling of the molten metal that would present a hazard and could well affect the service life or proper functioning of the lead delivery system.

Still further, a cost-effective lead delivery system is desired. More particularly, the overall system itself must be reliable and be capable of being both made and maintained during operation in service at costs consistent with the utility of the operation itself. Stated differently, unduly expensive apparatus could well not be cost-effective. It would also be undesirable to provide an apparatus which would prematurely wear out.

A further complicating requirement is that the lead delivery system must be capable of providing an accurate volume of molten lead to the molds for the straps in a reliable fashion over the desired service life. More particularly, it is important to provide a strap of the desired configuration with reliable, reproducible dimensions so as to achieve in the resulting lead-acid battery the desired electrical and other performance characteristics.

Likewise, commercial production makes it highly desirable to allow adjustability in service. For example, to allow handling straps of various configurations, it is desirable to provide a readily accessible way to adjust both the positioning of the lead delivery system relative to that of the molds as well as the amount of molten lead or lead alloy which is delivered to each of the molds. Further, and more importantly, it would be highly desirable to be able to maintain molten lead temperatures which vary as desired, to allow delivering molten lead or lead alloys at the same time to the molds for the positive straps which is at a temperature different than that of the molten lead delivered to the molds for the negative straps. Thus, it may be desirable to enhance the desired bonding between the strap lead or lead alloy and the lugs of the plates to dispense the molten lead to the molds at pre-selected and desired temperatures that could well vary by as much as perhaps 50° F. or even more from the temperature considered most desirable for bonding with other lugs. Thus, it is quite common to utilize different alloys for the positive and negative plates in commercially available maintenance-free batteries. To accommodate such varying conditions, it would be highly desirable to be able to tailor the strap alloy temperature to the particular plate alloy involved so as to present optimum bonding conditions.

There has been substantial prior effort in this field to provide apparatus for such lead delivery systems that accommodates these various requirements. U.S. Pat. No. 4,742,611 to Meadows et al. thus discloses a method and apparatus for joining lead battery parts (e.g., plate lugs, intercell connectors, terminals) together via a low resistance electrical coupling. U.S. Pat. No. 5,206,987 to Mix likewise discloses a method and apparatus for joining various lead battery parts together via a low resistance electrical coupling.

Still further, U.S. Pat. No. 5,146,974 to Mayer et al. discloses yet another apparatus for delivering molten lead for pouring lead straps in the manufacture of lead-acid batteries. The '974 patent discloses a variety of systems for pouring molten metals as well as some systems that have been specially adapted for use in the construction of batteries. As is pointed out therein, in addition to the problems normally encountered with any molten metal pouring system, special problems exist in the manufacture of lead-acid batteries where lead straps and the like must be poured accurately, quickly, efficiently and safely.

Yet, despite all of this considerable prior effort, there remains the need for a lead delivery system that can satisfy the special problems described by the '974 Mayer et al. patent, as well as the requirements as discussed herein. It is accordingly a primary object of the present invention to provide a lead delivery system for molten lead or lead alloy to the cast-on-strap molds which is characterized by reliable performance and is readily amenable to commercial assembly operations in the manufacturing of lead-acid batteries.

Another object provides an apparatus for delivering molten lead to cast-on-strap molds that is capable of being moved into and out of the position where molten lead is delivered to the molds in a relatively short time frequency.

Yet another object lies in the provision of a lead-delivery system which may be moved into and out of the lead delivery position in a fashion that essentially eliminates any possibility of spilling molten lead.

A still further object is to provide a lead delivery system characterized by cost-effective performance. A related and more specific object is to provide a lead delivery system that can be made initially at an expense level consistent with the value provided while having also an adequate service life in commercial production.

Yet a further object of the present invention is to provide a lead delivery system apparatus which can accurately provide the desired volume of molten lead to the cast-on-strap molds in a reliable, reproducible manner throughout a desired service life.

A still further object is to provide a lead delivery system apparatus that can be adjusted as is necessary in the lead-acid battery assembly process. A related and more specific object provides such a lead delivery system apparatus in which the molten lead supplied to a particular cast-on-strap mold can be maintained at the desired temperature, regardless of whether the desired temperatures for the respective positive and negative straps are the same or different.

These and other objects and advantages of the invention will be apparent to those skilled in the art upon reading the following description and upon reference to the drawings.

SUMMARY OF THE INVENTION

The subject invention provides an apparatus for delivering molten lead to a plurality of cast-on-strap molds which is readily amenable to use in current, commercial lead-acid battery assembly. According to one aspect of the present invention, the apparatus includes a lead supply member that includes a lead reservoir, at least one nozzle which communicates with the lead reservoir, a valve for each nozzle which allows the molten metal to be delivered through the nozzle when the apparatus is in a lead delivery position and a heater for maintaining the molten lead at a selected temperature. By positioning the outlet(s) of the nozzle(s) directly above the cast-on-strap molds, long feed lines that can lead to clogging and inaccurate volumes being provided is eliminated. A further aspect of the present invention involves a frame structure for mounting the lead supply member that functions to rotate the lead supply member between the lead delivery position and a wait, or home, position. By positioning the molten lead pool contained in the lead reservoir sufficiently close to the axis of rotation for the lead supply member, the apparatus of the present invention can be moved out of the way to the wait position after the desired molten lead has been supplied to the respective molds in a relatively quick period of time while still avoiding any safety issues such as spilling lead or the like. In the wait position, the lead supply member is positioned so that there is no interference with the strap casting step in which a cell element is positioned in the molten lead contained in the cast-on-strap mold.

The lead delivery apparatus of this invention likewise can be readily adjusted in a variety of ways to deal both with changing the spatial position of the cast-on-strap molds relative to the apparatus itself as well as adequately accommodating molds of different configurations that require delivering different volumes of molten lead. Further, and importantly, the lead delivery system of this invention is readily amenable to providing individual compartments for the respective nozzle(s) so that the molten lead provided to a specific mold is maintained at the desired temperature which may be the same or different for various straps of different polarities and the like.

DETAILED DESCRIPTION OF THE INVENTION

Figure 1:
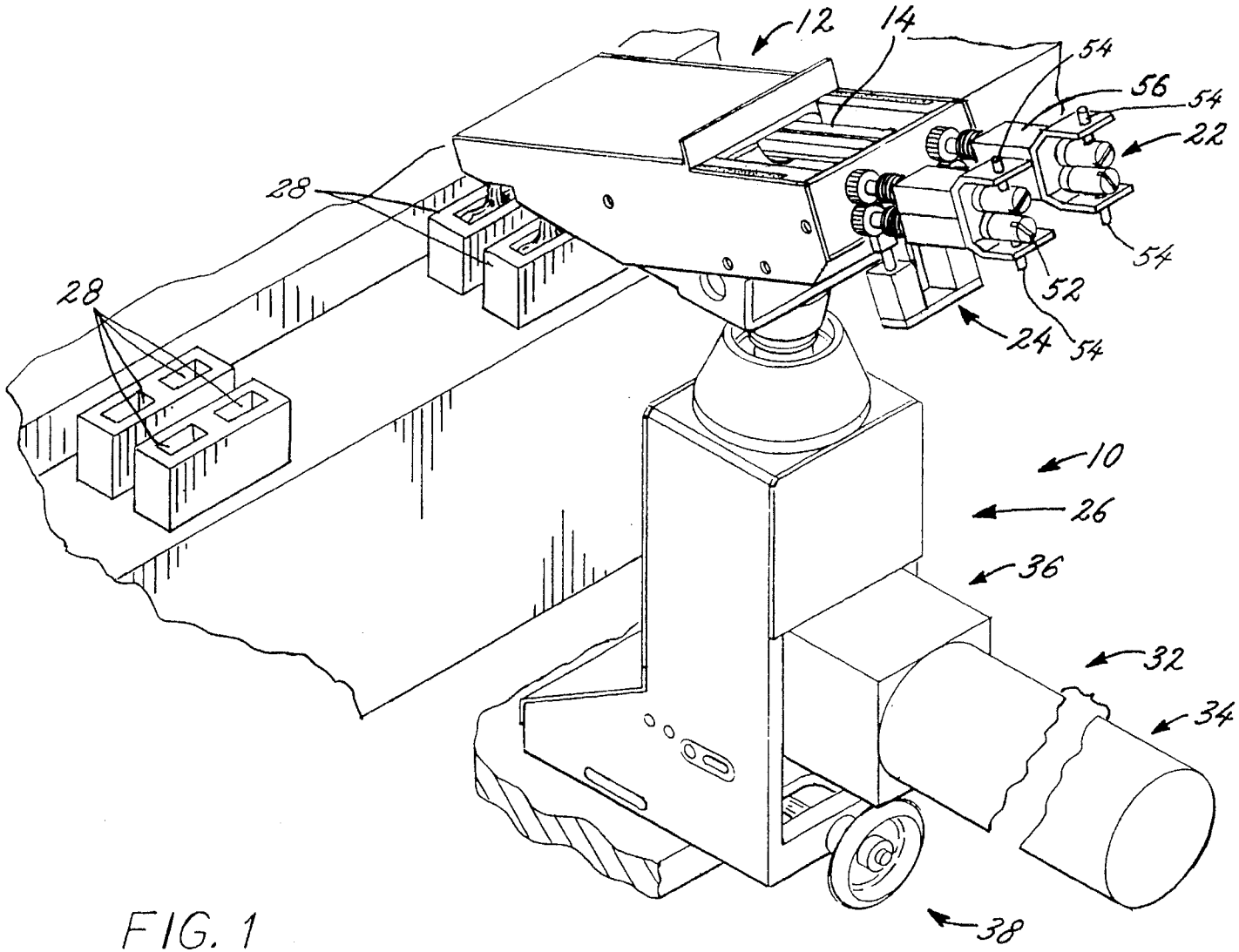
FIG. 1 is a perspective view of one preferred embodiment of the lead delivery apparatus of the present invention and illustrating the apparatus in the lead delivery position in which cast-on-strap molds are being filled.
Figure 6:
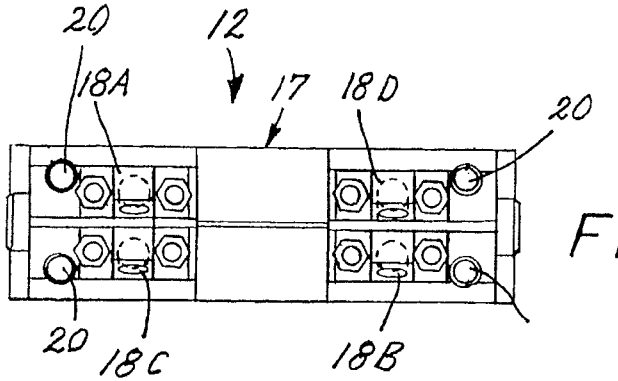
FIG. 6 is a front elevation view of the dispensing end of the lead delivery member shown in the embodiment of FIG. 1 and showing the relative positioning of the four nozzles and heaters employed in the illustrative embodiment.

In general, and as can be seen in FIG. 1, the lead delivery system 10 of the present invention comprises a lead supply member shown generally at 12. Lead supply member 12 comprises a lead reservoir 14, valves shown generally at 16 (FIG. 3) to regulate the dispensing of the molten lead through nozzles 18 and heaters shown generally at 20 for controlling the temperature of the molten lead as is desired (FIG. 6).

In the more preferred embodiment of the present invention, as is illustrated in FIG. 1, the lead supply member 12 includes volume adjustment structure shown generally at 22 and wear-controlling structure shown generally at 24. These preferred adjustment structures allow the volume of molten lead which is delivered to be readily changed as desired as well as insuring accuracy by achieving even wear of the valve structure in service.

Figure 2:
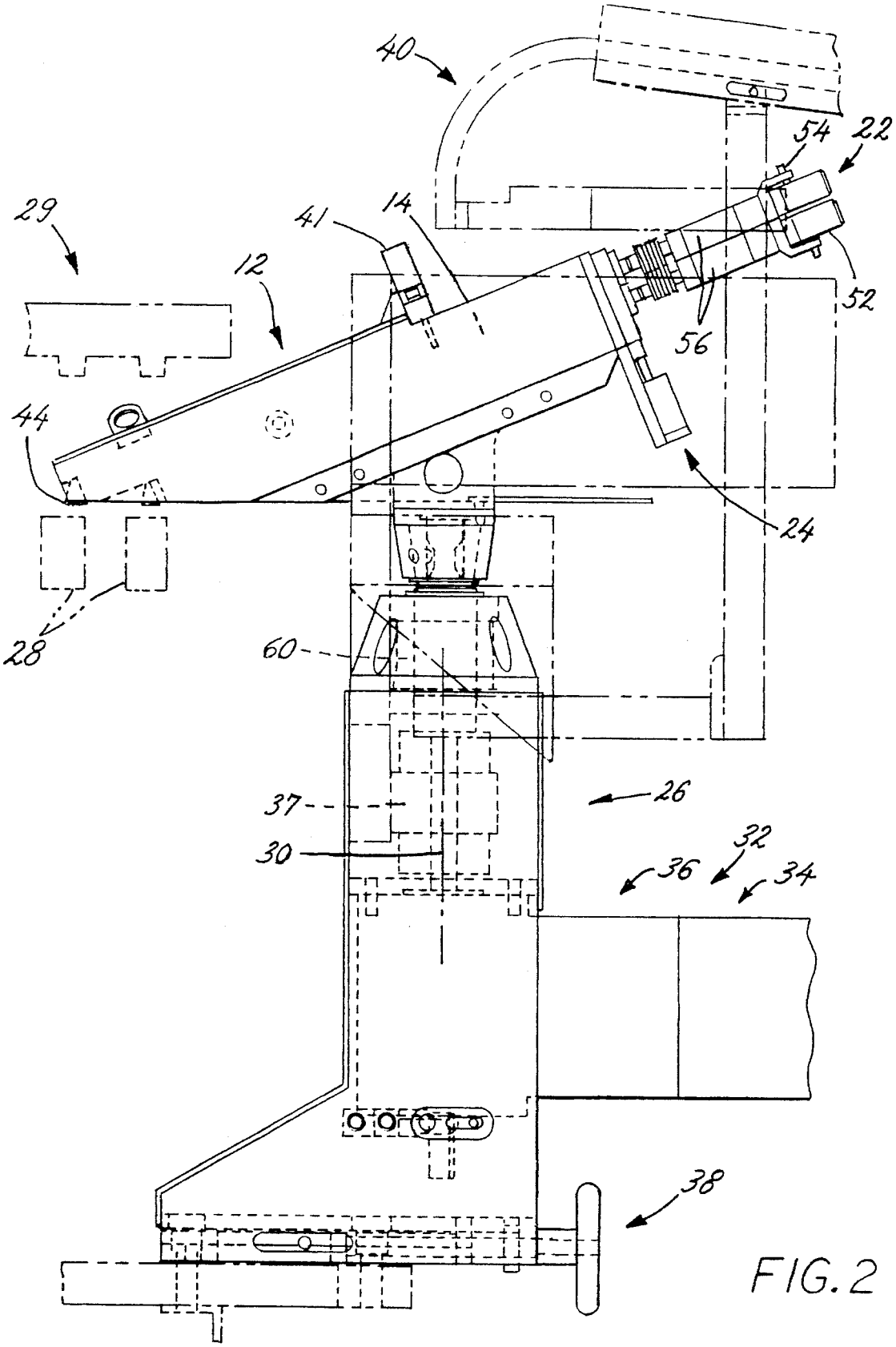
FIG. 2 is a side elevation view of the preferred embodiment shown in FIG. 1 and showing the relative positioning of the apparatus relative to other assembly mechanisms shown in phantom.

A frame structure shown generally at 26 is provided, and lead supply member 12 is mounted thereon so that it can be rotated from the lead delivery position to a wait position where the lead supply member 12 is out of the way of the strap molds 28 so that the cell elements can be inserted into the molds following filling and the straps cast on the cell elements (a clamp holding the cell elements with the plate lugs being shown in phantom at 29 in FIG. 2). According to one aspect of the present invention, the lead supply member 12 is positioned near the axis of rotation shown generally at 30 (FIG. 2) so that the lead supply member 12 can be rotated very rapidly without the rotational movement creating any significant wave motion or the like that could cause spilling of the molten lead.

The means for rotating the lead supply member is shown generally at 32. It has been found particularly useful to utilize a stepper motor 34 and a right angle gear reducer 36.

As also seen in FIG. 1, the lead delivery system 10 of the invention is preferably bolted or otherwise attached to the base plate of a cast-on-strap machine or to the floor or the like so as to provide sufficient stability. Further, in the preferred embodiment, linear adjustment structure is provided to allow in-and-out movement of the lead delivery system 10 relative to the molds 28 to allow the desired positioning of the lead supply member 12 and to achieve adaptability for use with various mold configurations and positions. To this end, linear adjustment structure 38 is provided.

Considering the respective elements of the lead delivery system of the present invention in greater detail, the lead supply member 12, as has been previously discussed, includes a lead reservoir 14. In accordance with one aspect of the present invention, as previously noted, the lead reservoir 14 is positioned sufficiently close to the axis of rotation 30 of the lead delivery system 10 so that the pool of molten lead is not unduly affected by the rotational movement of the lead supply member 12 from the lead delivery position to the wait position. Indeed, using the relative positioning shown in the illustrative embodiment, rotation can be effected in less than one-half second. Any relative positioning to the axis of rotation can be tolerated as long as rotation from one position (i.e., the lead delivery position) to the other (viz., the wait position) can be carried out in the time desired without any undue adverse effects.

As to the relative size of the lead reservoir 14, this can be dimensioned to provide a reservoir of molten lead to fill any number of molds desired for a particular application. Thus, with the configuration shown, the exposed reservoir of molten lead can be periodically filled by means well known so that the relative size of the lead reservoir is somewhat arbitrary. For example, as is known, the lead reservoir filling operation could be carried out from a relatively large lead reservoir contained in a vessel which maintains the molten lead at the desired temperature and is supplied through feed lines. Indeed, if desired, any of several known sensors may be used to maintain a desired level of molten lead. As is seen in phantom in FIG. 2, molten lead replenishing is accomplished as indicated at 40; and the level of molten lead is determined by sensor 41.

As one illustrative example, it has been found suitable to size and configure the lead reservoir such that the volume of molten lead is sufficient to fill about 16 to 20 cast-on-strap molds cavities. Since it is convenient to utilize mold pairs, and to use a sequencing operation in which a pair of dual molds are filled in one sequence (as will be discussed hereinafter), the illustrative volume provides more than enough molten lead to fill four or five sequences. In any event, as may be appreciated, it is desired to maintain a sufficient level of molten lead so that adequate material is available for dispensing and to avoid unduly low levels that would allow air to get into the system. In this regard, the canted or tilted positioning of the lead supply member in a horizontally downward direction toward nozzles 18 enhances the feeding of the molten lead to nozzles 18 as well as the availability for dispensing into the molds.

The particular source of molten lead, or more usually, a lead-based alloy, delivered to the cast-on-strap can be any desired source. The specific composition of the material does not form a part of the present invention. Rather, the lead delivery system of the present invention can be utilized with whatever alloy or lead source is desired for the strap materials for the particular application. Further, for convenience herein, the description will often refer only to molten lead; however, it should be understood that the intention is to include lead alloys as well.

As regards the nozzle and valve structure, what is important from the functional standpoint is that the valves utilized provide the desired service life and accuracy and the outlet of the nozzle structure is positioned directly above the cast-on-strap molds, such positioning obviating the need for long fill tubes which could become clogged or otherwise impaired in operation to create a variety of problems. In the illustrative embodiment, four nozzle structures are shown; and in this configuration, nozzles 18A and 18B deliver molten lead to strap molds for the positive plates while nozzles 18C and 18D feed molten lead for the negative plates.

Indeed, as may be appreciated, the number of nozzles used in the lead delivery system will, in general, be dictated by economy considerations as well as by compatibility with the type of cast-on-strap machine with which the lead delivery system is being used. If desired, a lead delivery system could be used that needs only one nozzle and fills only one mold cavity at a time. On the other hand, 12 nozzles could be included in the lead delivery system so that 12 mold cavities could be filled at one time, as is desirable for cast-on-strap machines that cast 12 straps at a time. Indeed, if desired, the lead delivery system of the present invention could be adapted to fill more than 12 mold cavities at one time.

Figure 3:
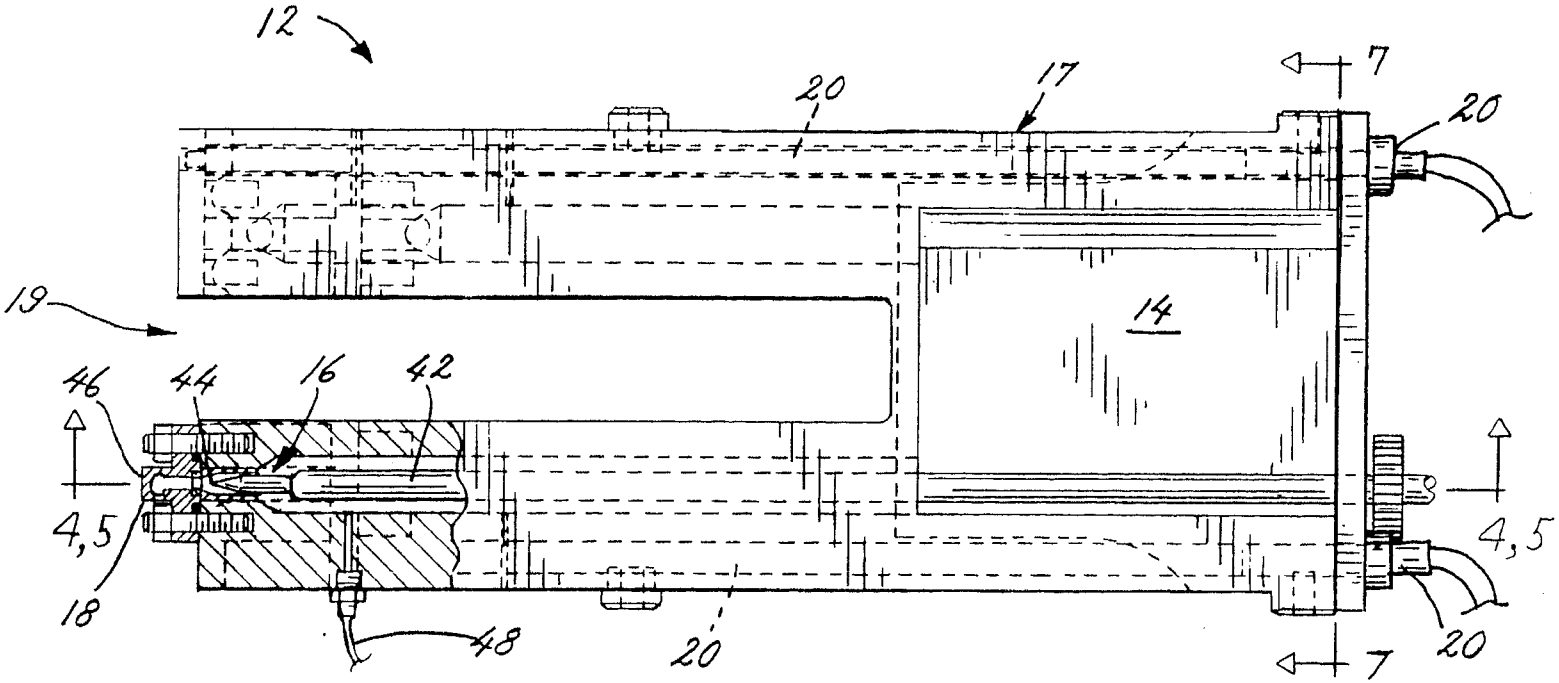
FIG. 3 is a top elevation view of the lead delivery member shown in the preferred embodiment of FIG. 1, and partially cut-away to show the valve being utilized.

Any desired type of valves may be used as is considered appropriate for the particular application. In the illustrative embodiments, valves 16 are needle valves and are contained in a block 17 (FIG. 3). Such valves have been found particularly desirable to regulate the volume of lead delivered. As shown in FIG. 3, valve stem 42 is retracted from valve outlet 44, allowing molten lead to pass therethrough.

Pursuant to a more preferred aspect of the present invention, a detachably mounted outlet orifice member is positioned adjacent the outlets of the needle valves 16 so as to intercept the molten lead flow and direct the flow downwardly into the desired molds. As seen in FIG. 3, outlet orifice member 46 can be attached to the lead supply source 12 by any means desired. For example, studs and nuts can be utilized so that, if needed, the outlet orifices can be readily maintained and/or replaced as considered desirable.

Figure 7:
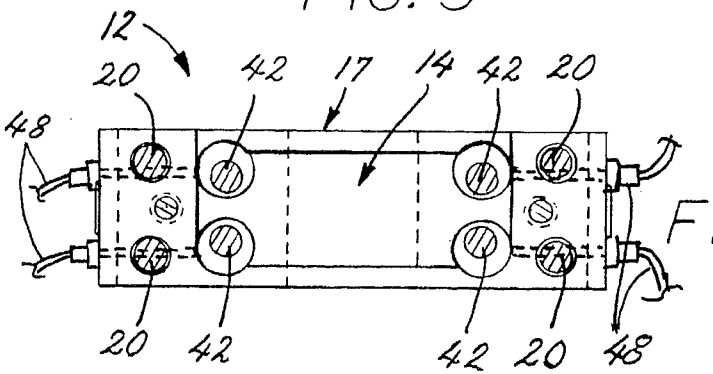
FIG. 7 is a back elevation view of the lead delivery member shown in the FIG. 1 embodiment and further showing the positioning of the valves and heaters being utilized.

As regards maintaining the reservoir of molten lead in the lead supply member at the temperature desired, a heater is used which maintains the temperature at the level desired for the particular application. As is illustrated in the preferred embodiments of the present invention, it has been found suitable to utilize cartridge heaters, each heater 20 being positioned adjacent a needle valve (FIGS. 6 and 7). While any type of heater could be used as desired, cartridge heaters combine compactness with satisfactory performance. Also, if desired, thermocouples or other sensors may be utilized to allow regulation of the cartridge heaters or other heating apparatus used as well as, ultimately, the temperature of the molten lead itself. Suitable sensing means and configurations allowing temperature adjustment of the heating means are well known. As shown in FIG. 3, positioning thermocouple 48 in the location illustrated has been found to be satisfactory.

According to a preferred aspect of the present invention, volume/flow adjustment structure is desirably included. As is best shown in FIGS. 1 and 2, the preferred volume adjustment structure, shown generally at 22, includes air cylinders 56 that can be actuated by known means to seat and unseat the needle valve stems as desired for the sequencing of the delivery of the molten lead. Flow adjustment can be readily made by an operator by turning knobs 52. As may be appreciated, adjustment of knobs 52 can either lengthen or shorten the extent to which the needle valve stem retracts (the length of travel being governed by a stop), and thus the volume of molten lead delivered. The illustrative preferred embodiment allows accurate and relatively quick change, when desired, without requiring any tools such as would be required with a structure including lock nuts or the like. Unwanted rotation of the adjustment structure can be achieved by using spring plungers 54. An adjustable timer or the like can be used to close the needle valves after the set time for delivery of the molten lead to the mold has elapsed, as is well known in the art.

Figure 8:
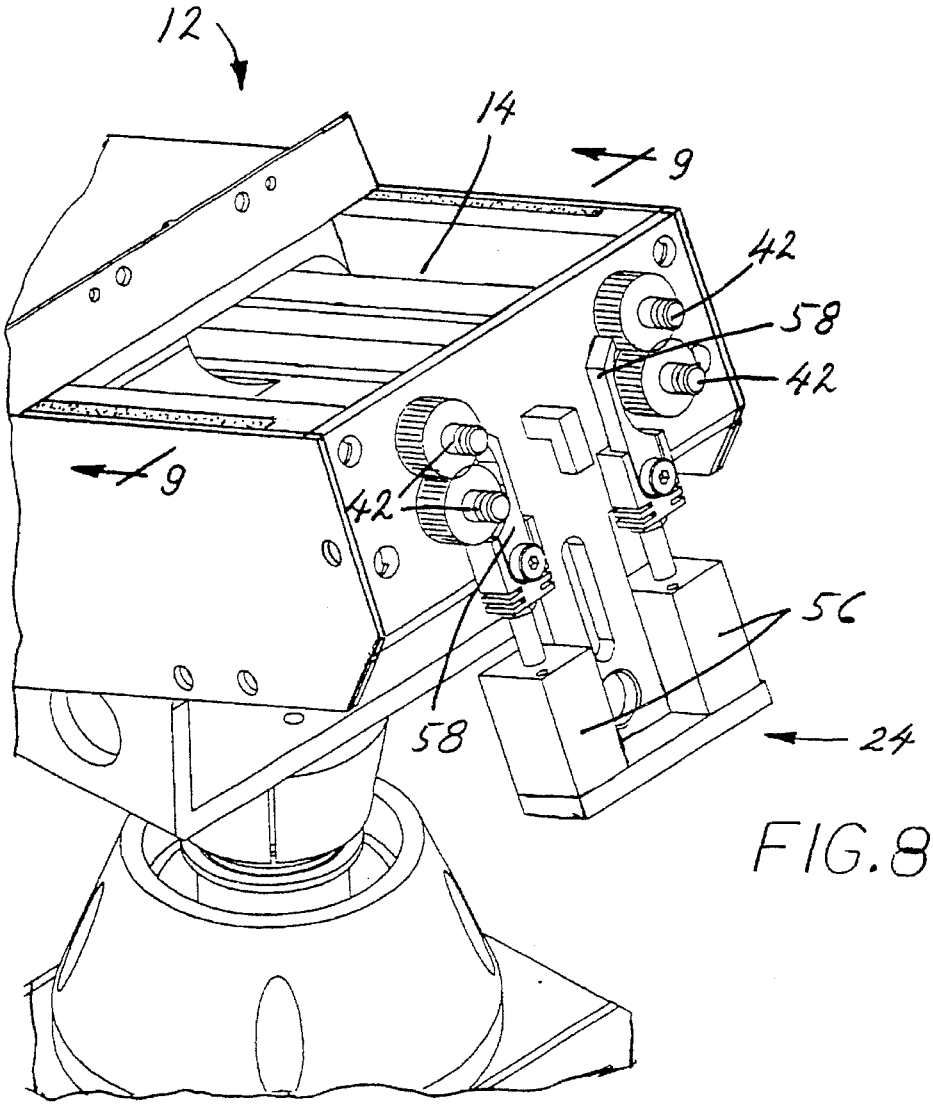
FIG. 8 is a partial perspective view of the preferred embodiment shown in FIG. 1 and illustrating the interior of the lead reservoir and the positioning of the needle valves therein, as well as further showing the wear-controlling rotating mechanism.

In order to achieve uniform wear on the circular sealing surface where each needle valve seats in its respective orifice, and thereby reduces dripping of molten lead that could result from uneven wear, wear-controlling structure is provided in the preferred embodiment of this invention. To this end, the wear-controlling rotating structure shown generally at 24 includes an air cylinder 56 and ratchet 58 (FIG. 8) which cooperate to turn gears on the needle valve stems 42. Each gear moves one tooth every time the system pours lead so as to provide the uniform wear. Any other desired mechanism for achieving uniform wear that would prevent premature failure in service can be utilized.

Figure 4:
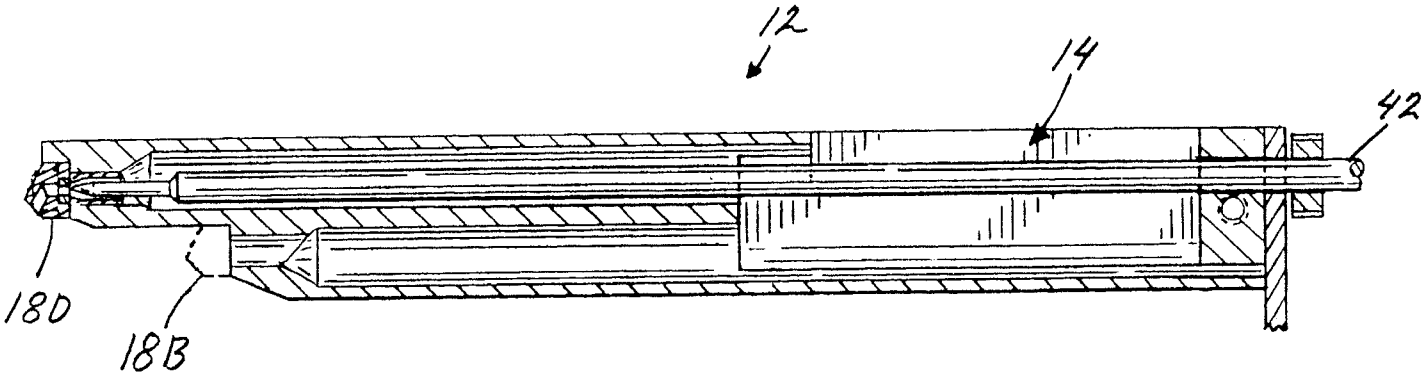
FIG. 4 is a cross-sectional view taken generally along line 4—4 of FIG. 3 and showing the positioning of one set of nozzles.
Figure 4A:
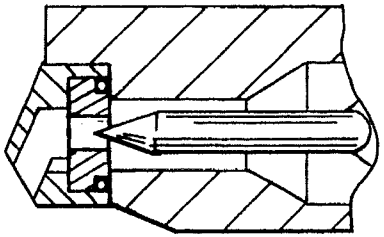
FIG. 4A is an enlarged partial cross-sectional view, similar to FIG. 4, and showing an insert in the outlet orifice member in which the valve stem seats.

Optionally, and preferably, to reduce premature wear and molten lead dripping, a seat insert can be provided for needle valve stem 42. This allows selection of suitable materials of the desired toughness at the high usage temperatures involved.. To this end, and as is best seen in FIG. 4A, the outlet orifice member 46 can include a seat insert 47 in the shape of a disc in which needle valve stem 42 seats. Any of a wide variety of materials are known and can be employed. An illustrative example of a suitable material is Carpenter No. 883 red tough tool steel. This can be used for both the seat insert and for the needle valve stem.

As may be appreciated, where undue wear has occurred, outlet orifice member 46 can be readily detached, and the seat insert replaced. This design approach provides considerable design variations as may be found desirable for particular applications. As one example, the seat insert 47 could be made of a slightly softer material than that for the valve stem so as to insure that it is the seat insert that wears out first, allowing for economies in maintenance.

Rotational ability is provided for the lead supply member by simply mounting the member on a shaft positioned within frame 26. To this end, and as best seen in FIG. 2, lead supply member 12 is mounted on shaft 60 for rotational movement. Shaft 60 can be maintained in position by bearings or the like, as may be appreciated.

The mechanism for rotating lead supply member 12 can be any desired mechanism, and several are known. In the illustrative preferred embodiment, it has been found particularly desirable to utilize a direct drive stepper motor 34 and a right angle gear reducer 36 (FIGS. 1 and 2), and, as may be appreciated, flexible coupling 37. This provides reduced maintenance by eliminating drive clutch, brake, and linear bearings, which could be used in other systems. In this fashion, and using the preferred rotating mechanism, the desired rotation from the lead delivery to the wait position and back can be rapidly effected. The illustrated direct drive provides the ability to rapidly accelerate/decelerate, thereby enhancing the ability to more quickly rotate the lead supply member 12.

The degree through which the lead supply member is rotated can be varied as desired. Functionally, the rotation should be sufficient to move the lead supply member out of the way of the apparatus used to insert the cell elements into the respective cast-on-strap mold. While using a degree of rotation of about 90° has been found suitable, it should be appreciated that a lesser degree of rotation may well prove useful in many applications depending upon the spatial constraints involved in the particular assembly operation.

As has been referenced herein, enhanced versatility in the preferred embodiments of the present invention include a mechanism for the linear or horizontal movement of the lead delivery system of the present invention in relation to the positioning of the cast-on-strap molds so as to ensure proper positioning of the molten lead flow relative to the molds. To this end, and as is shown in FIGS. 1 and 2, and has been discussed herein, the entire apparatus is supported by frame 26. Accordingly, by rotating linear adjustment mechanism 38, the entire apparatus can be moved horizontally (i.e., in and out relative to the molds).

As regards the materials of construction, any of a wide variety of materials can be used for components of the lead supply member 12 and for the frame 26. Thus, as suitable illustrative examples, the block 17 containing the nozzles and heaters can be made from steel or the like, desirably from a relatively conductive material to transfer heat to the lead. The frame structure can be made from steel, aluminum, or other materials possessing adequate strength. The air cylinder support structure can be made from a relatively low conductor such as stainless steel or titanium so as to protect the air cylinder seals from excessive heat.

Figure 9:
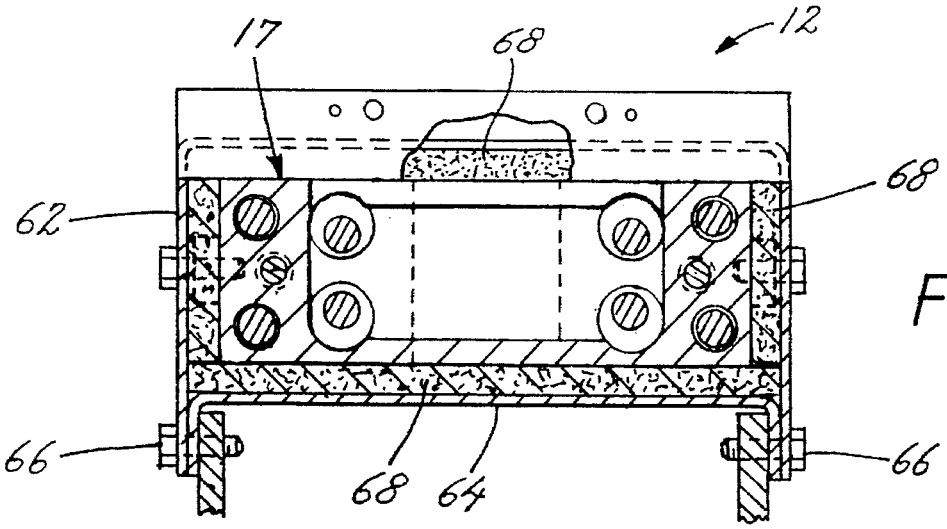
FIG. 9 is a cross-sectional view taken generally along line 9—9 of FIG. 8 and illustrating the position of optionally, and preferably used, insulation.

It should be appreciated that the particular structure of the lead supply member 12 can be varied as desired. All that needs to be provided is a structure that positions the lead reservoir, the nozzles, valves, and heaters in location to carry out the functions as described herein. As shown in FIG. 9, a sheet metal top cover 62 and a bottom cover 64 are attached together as with bolts 66, block 17 being positioned therein. Further, in the preferred embodiment, as seen in FIG. 9, heat retention is enhanced by positioning insulation 68 about block 17 and held in place by the top and bottom covers of the lead supply member 12. Any of a wide variety of insulating materials are known and may be utilized in whatever thickness desired. As one illustrative example, it has been found satisfactory to utilize fiberboard insulation (e.g., Carborundum "Duraboard") in thicknesses of ¼ and ½ inch.

Pursuant to a further important aspect of one preferred embodiment of the present invention, suitable structure is provided to allow the molten lead dispensed from an individual nozzle to be controlled at a temperature desired that is independent of the temperature of the molten lead dispensed from any other nozzle. Thus, to provide more desirable bonding between the particular alloy used in a specific application and the particular plate lugs (positive or negative), maintaining the molten lead at different temperatures may be quite desirable. More particularly, as one illustrative example, it may be suitable to maintain the molten lead temperature delivered to the cast-on-strap mold cavities for the positive plates at a higher temperature than that of the molten lead delivered to the mold cavities for the negative straps. To this end, one preferred embodiment of the present invention provides a lead supply member having separate compartments each equipped with a separate heating means so that the molten lead maintained in one compartment can be held at a desired temperature that is different from that of the molten lead in an adjacent compartment. In this fashion, fine tuning of the temperature desired can be achieved based upon practical experience derived from the conditions considered optimum for a particular molten lead alloy and strap configuration.

Figure 5:
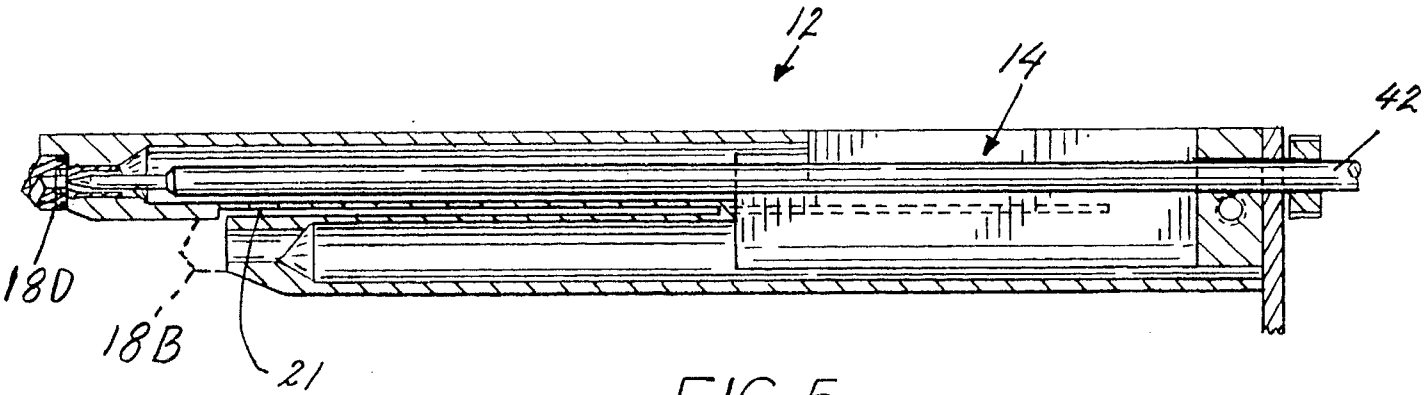
FIG. 5 is a cross-sectional view similar to FIG. 4, except showing a further preferred embodiment of the lead delivery apparatus of the present invention, and illustrating the separate compartments provided in the lead supply member, allowing individual temperature control of the molten lead delivered to each cast-on-strap mold.

In the illustrative embodiments, the lead supply member 12 is already divided into, in effect, two compartments (FIG. 3) due to space 19 in block 17. By providing a slot 21 in block 17 (FIG. 5), top and bottom nozzles 18A and 18C (and 18B and 18D) are effectively separated into individual compartments, adequately insulated one from the other to allow individual temperature control. As may be appreciated, the use of block 17 allows substantial versatility in manufacturing the lead delivery system desired. There is no need to form the block 17 with space 19 unless the number of nozzles and application make it desirable. However, with this configuration, this allows a structure to be easily made in which each nozzle and the molten lead therein are readily separated from any other nozzle. Of course, any other structure can be used which satisfies the features as described herein.

Any other arrangement that allows individual temperature control would similarly be useful. Further, as may be appreciated, the apparatus of the present invention could be modified to allow simultaneous delivery of different alloys for the positive and negative cast-on-strap molds. This could be achieved by compartmentalizing lead reservoir 14 to segregate the molten lead feed to the respective nozzles, and by using dual or multiple molten lead feed lines filling the respective compartments.

Thus, and as has been seen, the present invention provides a cost effective lead delivery system which satisfies the varying and rigorous requirements for dispensing molten lead in cast-on-strap applications. By positioning the lead source over the molds, the need to utilize pour tubes which can become clogged with oxidized lead or the like can be eliminated. In this fashion, more accurate control of the lead volume delivered can be achieved. Further, by positioning the reservoir of molten lead sufficiently close to an axis of rotation and by mounting the apparatus for rotation about that axis, safety considerations can be adequately satisfied while the sequencing cycle can be exceedingly short. In addition, in the more preferred embodiments of the present invention, a variety of easily made adjustments can be effected to further enhance the versatility of the system.

While this invention has been disclosed primarily in terms of the specific embodiments thereof, it is not intended to be limited thereto. For example, while the present invention has been specifically described in conjunction with a lead delivery system for filling cast-on-strap molds for lead-acid batteries, and such application presents special problems as discussed herein, it should be appreciated that the present invention could have utility in other applications. The present invention likewise could desirably be utilized in any mold filling application which requires sequential operations. Other modifications and embodiments and applications will be apparent to the worker in the art.

What is claimed is:

1. An apparatus for delivering molten lead to at least one cast-on-strap mold having a lead delivery position and a wait position comprising a lead delivery member having a lead reservoir sized to hold a volume of molten lead adequate to fill a plurality of cast-on-strap mold cavities, at least one nozzle communicating with said lead reservoir and having an outlet, a valve for each nozzle operable to allow molten lead to be delivered through said outlet of said nozzle when the apparatus is in the lead delivery position and a heater for maintaining the molten lead at a selected temperature, a frame structure for mounting said apparatus to allow said lead supply member to be rotated between the lead delivery and wait positions about an axis of rotation, means for rotating said lead supply member between the lead delivery and wait positions, said lead reservoir being positioned sufficiently close to the axis of rotation so as to allow movement of said lead delivery member at a selected rate between the lead delivery and wait positions, and the outlet of said nozzle being positioned directly above the cast-on-strap molds when said lead supply member is in the lead delivery position.

2. The apparatus of claim 1, wherein said lead reservoir is positioned higher than the outlets of said nozzles so that the molten lead flow from said lead reservoir to said outlets is generally downward.

3. The apparatus of claim 2, wherein said apparatus includes an outlet orifice positioned adjacent the outlet of said nozzle, said outlet orifices being positioned to intercept the molten lead flow through the outlet of said nozzle and having an internal flow path which directs the molten lead into the cast-on-strap molds.

4. The apparatus of claim 1, which includes a structure allowing adjustment of the volume of molten lead dispensed through the outlet of said nozzle.

5. The apparatus of claim 1, wherein the nozzle and valve comprise a needle valve having a valve stem.

6. The apparatus of claim 5, which includes structure for periodically rotating the valve stem of the needle valve.

7. The apparatus of claim 1, wherein said means for rotating said lead supply member comprises a right angle gear reducer and a stepper motor.

8. The apparatus of claim 1, which includes linear adjustment structure associated with said frame structure for moving said apparatus in a linear direction with respect to the cast-on-strap molds.

9. The apparatus of claim 1, wherein a plurality of mold cavities are to be filled with molten lead and one nozzle for each mold cavity is provided.

10. The apparatus of claim 9, wherein said lead reservoir has at least two separate compartments each supplying molten lead to a separate nozzle and each of said compartments having a heating means allowing for independent temperature control of the molten lead contained in each compartment.

* * * * *